United States Patent [19]

Heim

[11] 4,271,952

[45] * Jun. 9, 1981

[54] SERRATION DETECTOR

[75] Inventor: Edward L. Heim, Florissant, Mo.

[73] Assignee: Coin Acceptors, Inc., St. Louis, Mo.

[ * ] Notice: The portion of the term of this patent subsequent to Mar. 13, 1996, has been disclaimed.

[21] Appl. No.: 892,778

[22] Filed: Apr. 3, 1978

Related U.S. Application Data

[63] Continuation-in-part of Ser. No. 848,586, Nov. 4, 1977, Pat. No. 4,143,750.

[51] Int. Cl.[3] ..... G07F 3/02; G07F 3/04

[52] U.S. Cl. ..... 194/97 R

[58] Field of Search ..... 194/97 R, 97 A, 99, 194/102; 133/3 R

[56] References Cited

U.S. PATENT DOCUMENTS

| | | | |
|---|---|---|---|
| 3,120,300 | 2/1964 | Haverstick | 194/102 |
| 3,536,177 | 10/1970 | Foster et al. | 194/97 R |
| 3,592,307 | 7/1971 | Hammond | 194/97 R |
| 3,598,217 | 8/1971 | Hammond | 194/97 R |
| 4,143,750 | 3/1979 | Heim | 194/97 R |

*Primary Examiner*—Joseph J. Rolla

*Attorney, Agent, or Firm*—Cohn, Powell & Hind

[57] ABSTRACT

The selector assembly includes a support plate and a rail that directs a coin into a coin serration detector assembly. The serration detector assembly includes a body pivotally mounted to the support plate, and a coil spring having one end attached to the body, the opposite end being provided by a coil disposed transverse to and engageable with the edge of a coin moving in a predetermined trajectory from the rail. The end coil engages the serrations of a serrated coin to rotate the spring into the path of the serrated coin to change the trajectory and direct the serrated coin in one direction, and engages a substantially non-serrated coin to rotate the spring away from the trajectory and permit movement of the non-serrated coin in another direction.

4 Claims, 6 Drawing Figures

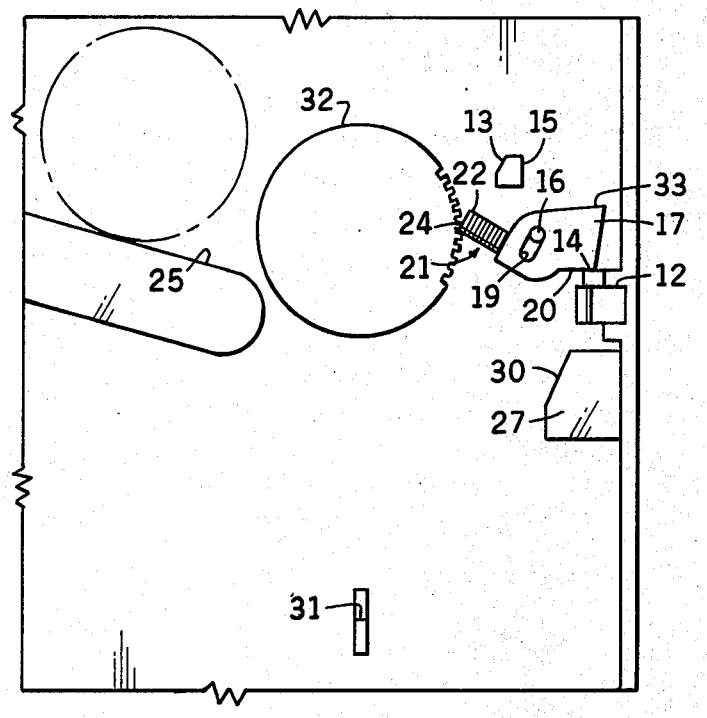
FIG. 3
FIG. 5
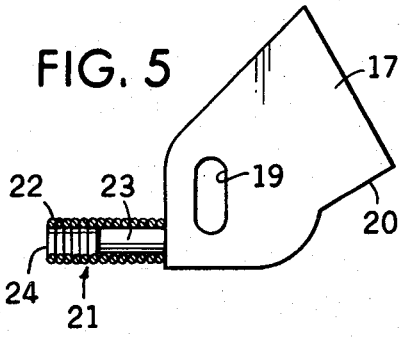
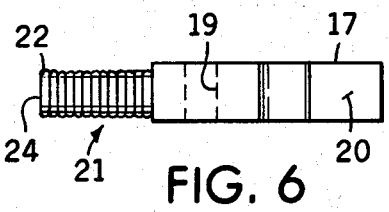
FIG. 6
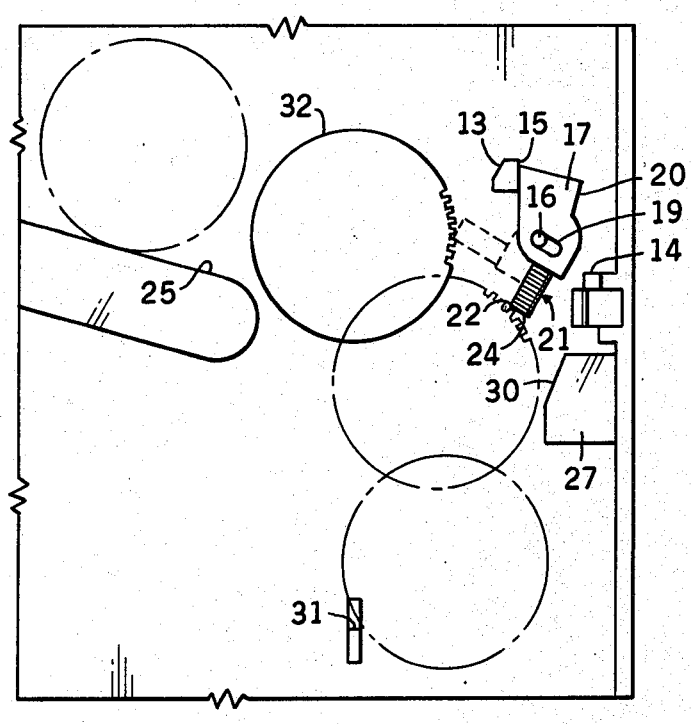
FIG. 4
FIG. 7
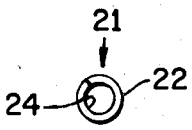

SERRATION DETECTOR

CROSS-REFERENCE TO RELATED APPLICATION

This application is a continuation in part of copending U.S. Pat. No. 4,143,750 issued Mar. 13, 1979.

BACKGROUND OF THE INVENTION

This invention relates generally to coin selecting and separating devices, and in particular to a device for detecting edge surface characteristics such as serrations.

In the known prior art, the separation of serrated and smooth-edged coins has been achieved by modifying the well-known coin cradle as is disclosed for example in U.S. Pat. No. 3,120,300. Coin cradles, which are basic to coin-selecting devices of the type under discussion, are useful for separating coins on a basis of size and weight. Selected coins are then directed into a predetermined path for further tests, such as the magnetic test for metal differentiation. Modification of the coin cradle so that it will perform the additional functions of accepting or rejecting coins on the basis of whether or not they have serrated edges obviously presents certain problems. Such a modified cradle, for example, is not easily susceptible to fine adjustment with regard to its new function of detecting coin serration, except at the risk of affecting the balance of the cradle. This balance, of course, is necessary if the cradle is to perform its original functions of size and weight separation adequately.

In serration detectors disclosed in U.S. Pat. Nos. 3,592,307 and 3,598,217, owned by the same assignee, the feeler is comprised of a thin spring steel blade molded into a zinc base die cast or plastic body. This spring steel blade is then trimmed to length after molding. Because of variation in blade material and production trim equipment, the condition of the detector blade surface operating on the coin edge is of variable and inconsistent quality. This variable produces erratic and unpredictable operation of the serration detector in the final acceptor assembly, such that smooth edge slugs may be accepted as genuine coinage and/or genuine coinage may be rejected as slugs.

In the serration detector disclosed in U.S. Pat. No. 3,536,177, the feeler is rotatively mounted bearing at the end of a leaf spring.

SUMMARY OF THE INVENTION

The present device is independent of the basic cradle and provides a separate stage in a coin-selecting mechanism for performing the function of separating serrated and nonserrated coins. Because of its independence, the serration detector is susceptible to balancing adjustment which is not available in the modified cradle serration detector.

This serration detector utilizes a coil spring as the feeler and is disposed so that the end coil of the spring engages the coin edge. The wire radius forming the spring, and particularly the last coil, can be relied upon to be consistent from part to part, and thereby effectively eliminates the above discussed disadvantages of using a trimmed end on a spring steel blade.

The selector assembly is located downpath of a rail on a support which directs a coin in a predetermined trajectory. The serration detector in the selector assembly includes a body pivotally mounted to the support, and a coil spring having one end attached to the body, the opposite end being provided with a coil disposed transversely to and engaging the edge of a coin moving in the predetermined trajectory. The end coil engages the serrations of a serrated coin to rotate the spring in one direction to change the trajectory and direct the serrated coin into one path, and engages a substantially non-serrated coin to rotate the spring in the opposite direction and permit movement of the non-serrated coin into another path.

The end coil of the coil spring has a transverse portion that is engageable with the coin edges. More particularly, the bottom transverse portion of the end coil engages the coin edges.

The end coil of the coil spring is of a predetermined cross-sectional dimension to provide reliable reaction of the end coil with the serrated and non-serrated coin edges.

The coil spring resiliently mounts the end coil engageable with the coin edge, and flexes to reduce stress from coin impact.

BRIEF DESCRIPTION OF THE DRAWING

FIG. 3 is a fragmentary elevational view of the selector assembly illustrating the disposition of parts immediately upon feeler engagement with a serrated coin;

FIG. 4 is a fragmentary elevational view of the selector assembly illustrating the disposition of parts immediately following feeler engagement with a serrated coin;

FIG. 5 is an enlarged side elevational view, partly in cross section, of the serration detector used in the assembly of FIGS. 1–4;

FIG. 6 is a bottom plan view of the serration detector shown in FIG. 5, and FIG. 7 is an end view of the spring shown in FIG. 5.

DESCRIPTION OF THE PREFERRED EMBODIMENT

Referring first to FIGS. 1–4, it will be understood that the complete coin acceptor device 10 is not shown. Only such details of the complete device 10 are shown as are believed necessary to the explanation and description of those parts of the device which are pertinent to an understanding of the selector assembly for detection of serrated and non-serrated coins. Prior stages of the coin acceptor mechanism in which the coin is deposited into a suitable slot and directed into a cradle mechanism are omitted for clarity. Likewise, such mechanism as is used for separating coins with respect to their metallic content are omitted.

Figure 1:
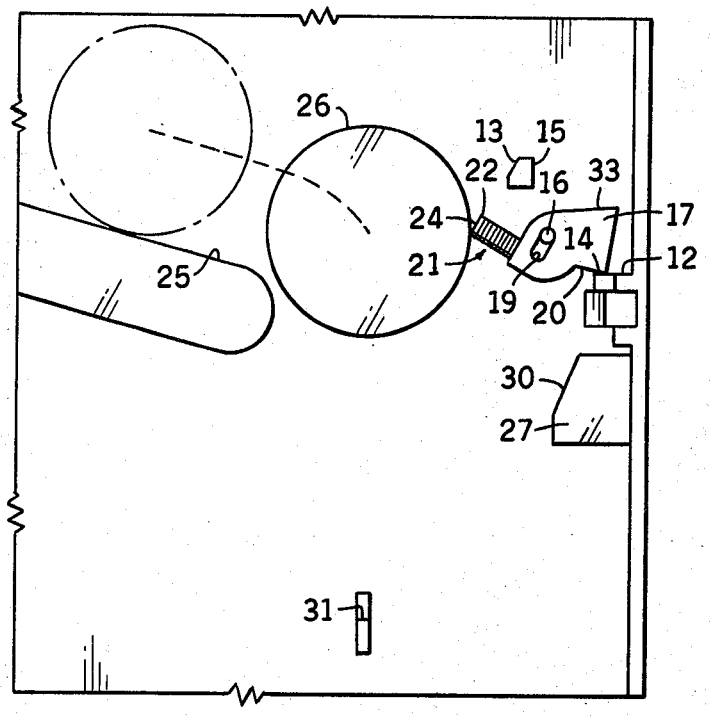
FIG. 1 is a fragmentary elevational view of the selector assembly illustrating the disposition of parts immediately upon feeler engagement with a non-serrated coin.
Figure 2:
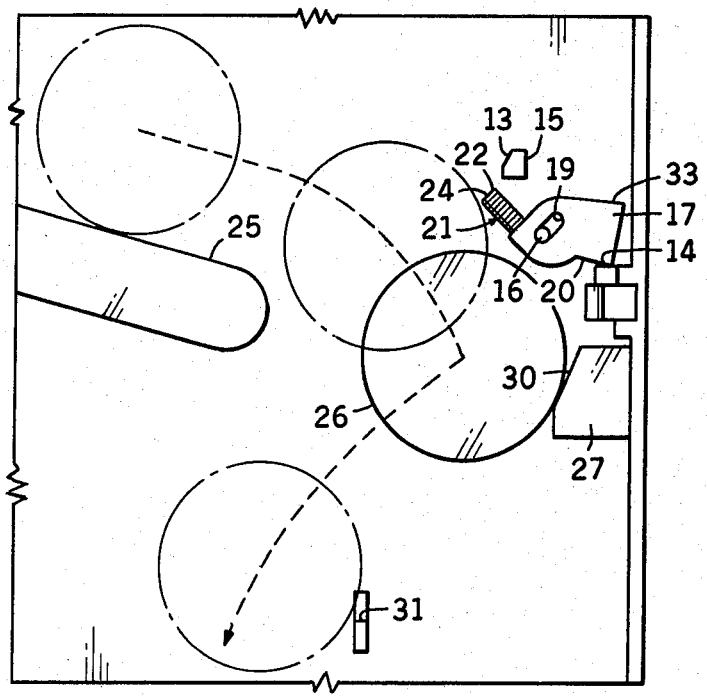
FIG. 2. is a fragmentary elevational view of the selector assembly illustrating the disposition of parts immediately following feeler engagement with a non-serrated coin.

FIG. 1 shows the disposition of selector parts immediately upon engagement with a coin, and in particular shows the engagement with a non-serrated coin. FIG. 2 shows the disposition of selector parts after such engagement with a non-serrated coin. FIGS. 3 and 4 illustrate the dispositions of the various parts of the coin selector assembly when subjected to the action of a serrated coin.

Referring now by characters of reference to the drawings, and first to FIG. 1, it will be understood that the coin selector device 10 includes a support plate 11 constituting a support means. Formed on the support plate 11 are a pair of projecting stop means 12 and 13 providing first and second abutments 14 and 15 respectively. A pin 16, constituting a pivot means, is attached to and projects outwardly from the support plate 11.

The serration detector includes a body 17 having a slot 19 that receives the pivot pin 16. A shoulder 20 on the body 17 seats on the abutment 14 in the inoperative position of the serration detector. Thus, the pin 16 and the abutment 14 constitute a mounting means, mounting the serration detector to the support plate 11. The center of gravity of the serration detector lies between the abutment 14 and the slot 19. This arrangement assures that the serration detector is at rest when inoperative.

The serration detector also includes a coil spring 21, constituting a wire feeler, attached to the body 17 and providing an end coil 22 disposed transversely to and engaging the edge of a coin moving in a predetermined trajectory as will be later explained. One end of the coil spring 21 is attached to the body 17 by fitting over a projecting body pin 23, the other end of the coil spring 21 is provided by end coil 22 having a bottom portion 24 that is transverse to the longitudinal axis of the coil spring 21 and engageable with the coin edge. The wire forming the coil spring 21 is of a predetermined cross-sectional dimension to provide reliable reaction of the transverse coil portion 24 of the end coil 22 with serrated and non-serrated coin edges. The coil spring 21 resiliently mounts the transverse coil portion 24 of the end coil 22 and flexes to reduce stress from coin impact.

A rail 25, provided adjacent to the support plate 11, is located in spaced relation from the coil spring 21. This spaced relation is such that a coin traveling down the rail 25 leaves the rail 25 in a predetermined trajectory, direct into engagement with the coil spring 21. In other words, the transverse coil portion 24 of end coil 22 intercepts the envelope of trajectory of the coin, the envelope being defined by the diameter of the coin, and engages the coin edge, as is best shown in FIGS. 1 and 3.

FIG. 2 indicates the path of the non-serrated coin 26 after engagement with the coil spring 21. Because the coin 26 has a substantially smooth edge, the engagement by the coin 26 with the transverse bottom coil portion 24 of end coil 22 results in the coil spring 21 moving upwardly under the impact of the coin 26 and carrying the body 17 with it. The body 17 swings about the seating of the shoulder 20 on the abutment 14, and the cooperation between the slot 19 and the pin 16 received therein, acts to guide and limit the upward swinging movement.

The body 17 has a relatively small mass and in consequence, the coin 26 continues on a forward and a downward path. A kicker 27 is disposed in spaced relation below the coil spring 21 downward of the non-serrated coin path. When the coin 26 impinges on the kicker face 30, the coin 26 is directed into a changed, predetermined path or direction. The momentum remaining in the coin 26 carries the coin 26 to one side (the left side of FIG. 2) of a second kicker 31, from whence it is carried into a rejection channel for return to the vending machine customer.

FIGS. 3 and 4 are comparable to FIGS. 1 and 2, except that the operation of the coin serration detector is considered in conjunction with a serrated coin 32. FIG. 3 is identical with FIG. 1 except that the bottom transverse coil portion 24 of end coil 22 is on the point of engagement with the serrations of the serrated coin 32. At this point, the coil spring 21 is in precisely the same position as for a non-serrated coin 26 in FIG. 1. That is to say, the bottom transverse coil portion 24 of the coil spring 21 lies within the trajectory envelope of the coin 32.

FIG. 4 illustrates the disposition of the serration detector following feeler engagement with the serrated coin 32. The coil spring 21 is shown in broken outline in FIG. 4 to indicate the original position of FIG. 3. The momentum of the serrated coin 32, after engagement by the bottom transverse coil portion 24, rotates the coil spring 21 and the body 17 about the pin 16, thereby directing the coin 32 into a path or direction which is substantially vertical, at which time the coin 32 becomes disengaged from the bottom transverse coil portion 24.

The second abutment 15 of the stop means 13 is disposed in spaced relation from the pin 16, whereby to limit rotation of the body 17 about the pin 16. The abutment 15 is engaged by the shoulder 33 of the body 17 at the desired rotational limit to prevent the serration detector from rotating too far.

The disposition of the kicker 27 is sufficiently horizontally spaced from the downward path of the coin 32 to avoid contact with the coin 32. The second kicker 31 is disposed in spaced relation below the coil spring 21 and is spaced to one side of the substantially vertical path of the coin 32. When the coin 32 contacts the kicker 31, the coin is deflected to one side of the kicker 31 (the right side in FIG. 4), thereby directing the coin 32 to trigger the vending mechanism.

It is thought that the functional advantages of this coin serration detector have become fully apparent from the foregoing description of parts, but for completeness of disclosure, the operation of the device will be briefly described.

It will be assumed that the vending machine is intended to accept coins of a particular denomination which have serrated edges, and rejects slugs or coins of substantially the same size and weight as the authentic coin, but without serrated edges. A slug 26 which has passed the weight and size test controlled by the cradle (not shown) will roll down the rail 25 and follow a predetermined trajectory which will lead it into direct contact with the bottom transverse coil portion 24 of end coil 22 of coil spring 21 of the serration detector. Because such a slug has a smooth edge, the coil spring 21 is simply pushed upwardly, pivoting about the seating of the shoulder 20 on the abutment 14. The slot 19 receiving the pin 16 permits and guides this upward movement.

The slug 26 has retained sufficient forward momentum after engagement with the coil spring 21 to carry it into contact with the face 30 of the first kicker 27. It strikes the kicker 27 and rebounds into a new path which ultimately brings it into contact with the second kicker 31, and is directed to the left of such kicker 31 and hence to a rejection path leading to a coin return (not shown).

The path of the authentic coin 32, up until the time it engages the coil spring 21, is substantially the same as that of the slug 26. However, as clearly shown in FIGS. 3 and 4, the bottom transverse coil portion 24 of the end coil 22 of the coil spring 21, on engagement with the serrated edge of the coin 32, causes the serration detector to rotate about the pin 16 in a counter-clockwise direction. This rotation moves the coil spring 21 downwardly toward the trajectory, rather than away from it, and substantially divests the serrated coin 32 of forward momentum, and directs the coin 32 into a substantially downward path to contact the second kicker 31 and be directed to the right side of the second kicker 31. This serrated coin 32 is then directed to appropriate mechanism that results in the triggering of the vending machine.

I claim as my invention:

1. A serration detector in a selector assembly for serrated and non-serrated coins in a coin acceptor and located downstream of a rail on a support which directs a coin in a predetermined trajectory, the serration detector comprising:

(a) a pivotally mounted body, and (b) a coil spring having one end attached to the body, the opposite end being provided by a coil disposed transversely to and engaging the edge of a coin moving in the predetermined trajectory, the end coil includes a portion transverse to the longitudinal axis of the coil spring engaging the serrations of a serrated coin to rotate the spring in one direction to change the trajectory and direct the serrated coin into one path, and engaging a substantially non-serrated coin to rotate the spring in the opposite direction and permit movement of the non-serrated coin in another path.

2. A serration detector as defined in claim 1, in which:

(c) the transverse portion is the bottom of the end coil engageable with the coin edges.

3. A serration detector as defined in claim 1, in which:

(c) the end coil is of a predetermined cross-sectional dimension to provide reliable reaction of transverse portion of the end coil with the serrated and non-serrated coin edges.

4. A serration detector as defined in claim 1, in which:

(c) the transverse portion is the bottom of the end coil engageable with the coin edges, and (d) the spring has coils of a predetermined cross-sectional dimension to provide reliable reaction of the bottom transverse portion of the end coil with the serrated and non-serrated coin edges.

* * * * *